US005300261A

United States Patent [19]

Von Berg

[11] Patent Number: 5,300,261

[45] Date of Patent: Apr. 5, 1994

[54] LIQUID AERATING APPARATUS

[76] Inventor: Richard Von Berg, 4403 Alvin St., Saginaw, Mich. 48603

[21] Appl. No.: 974,948

[22] Filed: Nov. 12, 1992

[51] Int. Cl.[5] ..... B01F 3/04

[52] U.S. Cl. ..... 261/87; 261/DIG. 42

[58] Field of Search ..... 261/87, DIG. 42

[56] References Cited

U.S. PATENT DOCUMENTS

| | | | |
|---|---|---|---|
| 2,075,384 | 3/1937 | Vretman | 261/87 |
| 2,187,746 | 1/1940 | Lefevre | 261/87 |
| 3,108,146 | 10/1963 | Gross | 261/87 |
| 3,382,980 | 5/1968 | Silva | 261/87 |
| 3,975,469 | 8/1976 | Fuchs | 261/87 |
| 4,200,597 | 4/1980 | Baum . | |
| 4,231,974 | 11/1980 | Englebrecht et al. | 261/87 |
| 4,280,911 | 7/1981 | Durda et al. . | |
| 4,308,221 | 12/1981 | Durda . | |
| 4,371,480 | 2/1983 | Vos . | |
| 4,437,765 | 3/1984 | Seeger . | |
| 4,741,870 | 5/1988 | Gross . | |
| 4,844,843 | 7/1989 | Rajendren | 261/87 |
| 4,954,295 | 9/1990 | Durda . | |
| 5,013,490 | 5/1991 | Tanimoto et al. . | |

FOREIGN PATENT DOCUMENTS

| | | | |
|---|---|---|---|
| 2712465 | 10/1977 | Fed. Rep. of Germany | 261/87 |
| 1250266 | 11/1960 | France | 261/87 |
| 53-25272 | 3/1978 | Japan | 261/87 |

*Primary Examiner*—Tim Miles

*Attorney, Agent, or Firm*—Learman & McCulloch

[57] ABSTRACT

Apparatus for aerating a pool of liquid has a hollow, rotatable drive shaft journaled for rotation about an axis and coupled at one end to a driving motor. A propeller is mounted at the other end of the drive shaft. The propeller has a plurality of hollow blades in communication with an internal aerating fluid passage in the drive shaft. A plurality of air inlets is provided in the drive shaft and at least one outlet port is provided in each blade at the zone of highest negative pressure resulting from rotation of the blade in the liquid. The drive shaft automatically is movable from a dry-docked position in which the shaft is out of the liquid to an operating position in which the propeller blades are immersed in the liquid. A seal is provided between the propeller and the shaft journal to protect the latter against exposure to the liquid. The shaft is continuously pressurized between the journal and the seal to prevent liquid from passing through the seal should the seal become worn.

12 Claims, 4 Drawing Sheets 10
12
14
16
30
32
34
42
50
52
54
56
63
72
74
76
80
102
104
106
108
110
112
116
118
120
122
128
130
W

LIQUID AERATING APPARATUS

This invention relates to apparatus for agitating and aerating liquids such as waste water in pools or ponds.

BACKGROUND OF THE INVENTION

Aeration of waste water is known and involves introducing air into the water and mixing the air and water to promote biological consumption of algae and other pollutants present in the water.

Various mechanical aeration devices have been proposed utilizing a submerged propeller coupled to a draft tube. Rotation of the propeller agitates the water and creates a differential pressure which draws air through the draft tube for discharge into the water. To treat water effectively and efficiently with such mechanical devices, it is desirable to introduce into the water as much air as possible per unit of time and as a dispersion of very small bubbles. It also is desirable to produce as much thrust as possible from the propeller to force the air bubbles deeply into the water for optimizing retention time of the air bubbles in the water. Preferably this is accomplished with minimum consumption of energy.

Known mechanical aerator devices have included hollow hub-type aerators such as those disclosed in U.S. Pat. Nos. 4,280,911; 4,308,221; 4,954,295; and 4,741,870. Each of these devices includes rotatable propeller blades for generating low pressure in the vicinity of the propeller hub causing air to be drawn through a draft tube and out of the hub for discharge into the water. Such devices require rotation of the propeller at high velocity in order to generate sufficiently low pressure to draw air through the tube. Rotating the propeller at high speeds results in high energy consumption and produces a rather coarse dispersion of air bubbles in the water which negatively affects aeration efficiency.

Other aeration devices have been proposed utilizing propellers having perforated hollow blades communicating with atmosphere through a draft tube. Like the hollow hub aeration devices described above the hollow blade devices conduct the air or other fluid to the liquid under the influence of suction generated by the rotation of the propeller in the liquid. Since the blades rotate at a relatively higher circumferential velocity than the hub, increased aeration can be produced by providing outlet ports in the blade rather than in the hub. Examples of known hollow blade aerating devices appear in U.S. Pat. Nos. 4,200,597; 4,371,480; and 5,013,490.

In the operation of aerator devices of the kinds described above, positive air pressure at the air outlets produced as a result of rotation of the propeller prevents the backing of liquid into the draft tube through the outlets. When the propeller is not rotating, however, water can enter the draft tube via the air outlets. Such a result is particularly objectionable when treating waste water of a sewage treatment facility since, over time, algae and other bacterial matter accumulate in the draft tube and block the air passages.

Waste water also may be so corrosive as to damage bearings and seals within the draft tube. In order to avoid such problems, it presently is necessary manually to dry dock or remove the aerator from the water so that the air outlets are above the surface of the water.

Some manufacturers of aeration devices have replaced conventional antifriction bearings with water bearings as a means for extending the bearing life of the aerator. Wet bearings, however, also are prone to attack by waste water and require replacement after a short period of time. In contrast, ball or roller bearings will last considerably longer than wet bearings if they are adequately protected from exposure to the waste water. The Gross patent referred to above discloses a conventional antifriction bearing journaling the drive shaft, but such bearing is located above the surface of the waste water to prevent its exposure to the water. This construction results in several feet of the drive shaft extending beyond the bearing, thereby requiring support from a cantilever sleeve and additional wet bearings, resulting in additional complexity and cost in the manufacture of such devices.

SUMMARY OF THE INVENTION

Liquid aeration apparatus constructed according to the invention comprises a drive shaft journaled for rotation about an axis and coupled to a driving motor. A propeller fixed to the drive shaft is immersible in the liquid. The propeller includes helical or pitched blades each of which has an airfoil profile between the leading and trailing edges thereof defining relatively high and relatively low pressure areas at opposite sides of the blade so that rotation of the blade in the water produces a low or negative pressure at one side of the blade along its trailing edge and which is greatest at a zone radially inward of the blade tip. The blade has an internal chamber communicating with a treatment fluid such as air. The chamber terminates radially inward of the blade tip and includes an outlet port at the zone of greatest negative pressure for discharging the treatment medium into the liquid in response to rotation of the blade.

The aeration apparatus utilizes an efficient blade design which achieves increased fluid displacement per unit time and consumes less energy as compared to known aerators. Locating the air outlet port radially inward of the blade tip at the zone of greatest negative pressure produces a fine air bubble distribution and high aeration efficiency. Additionally, such location of the air outlet port enables the use of an energy efficient, low pitch propeller which is able to be rotated at a lower velocity while displacing great amounts of water liquid per unit time. The strategic location of the air outlet ports also enables the device to be operated at great depth because of the large suction created by the blade design. Increasing the operating depth directly increases the aeration efficiency by prolonging the suspension of the bubbles in the liquid.

Aeration apparatus constructed in accordance with the invention comprises a rotatable drive shaft journaled on a support arm, a motor coupled to the drive shaft for rotating it about an axis, and a propeller fixed to the shaft for rotation therewith. The shaft has fluid passages through which treatment fluid may pass in response to rotation of the propeller for subsequent discharge through fluid outlets in the propeller blades into the liquid.

The shaft is mounted for movement from a first or inactive position in which the fluid outlets in the blades are above the surface of the liquid to a second position in which the blades and the fluid outlets are submerged. In the inactive position the propeller blades are so positioned with respect to the liquid that rotation of the propeller causes the tips of the blades to engage the liquid. The pitch of the blades is such that the reaction between the tips and the liquid automatically effects movement of the propeller blades to the second position. The blades remain in the second position during rotation of the propeller, but once rotation slows below a predetermined speed, the shaft and the propeller automatically are restored to the inactive position.

The propeller drive shaft is journaled by antifriction bearings at two axially spaced positions, one of which is remote from the propeller and the other of which is adjacent the propeller. The bearings adjacent the propeller are protected against contact by the liquid by a seal. The space between the bearings and the seal preferably is maintained under pneumatic pressure to compensate for wear of the seal.

If the treatment fluid is air, it is desirable in some instances to convert oxygen in the air to ozone. In other instances it is desirable to use ozone as the treatment fluid. Apparatus constructed according to the invention enables either alternative to be realized.

Other objects and advantages of this invention will become apparent from the following description when considered in conjunction with the accompanying drawings.

THE DRAWINGS

Figure 3:
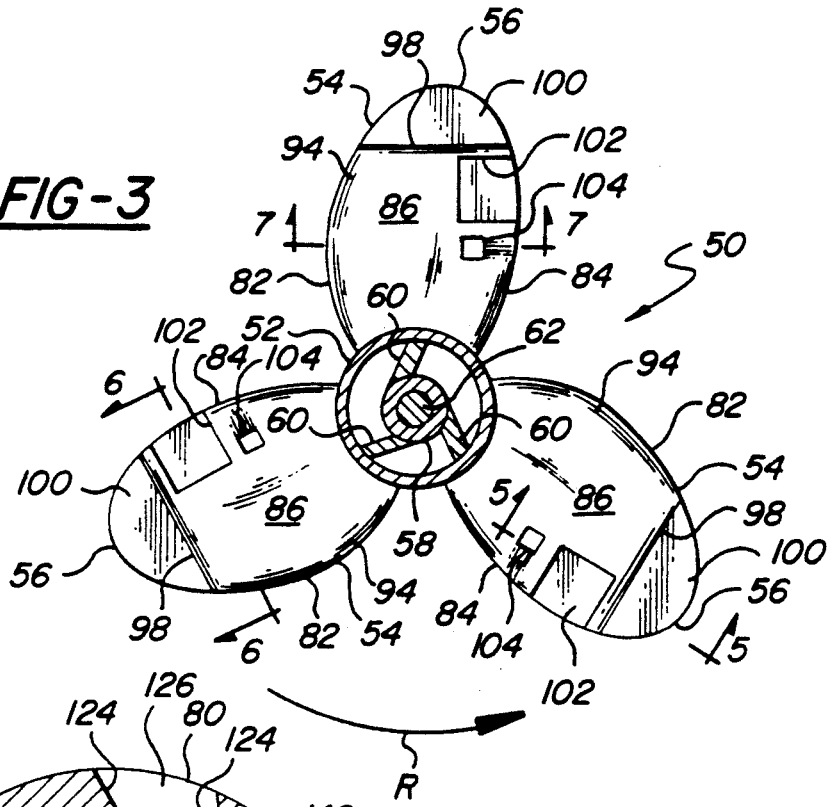
FIG. 3 is a sectional view taken on the line 3—3 of FIG. 2.
Figure 6:
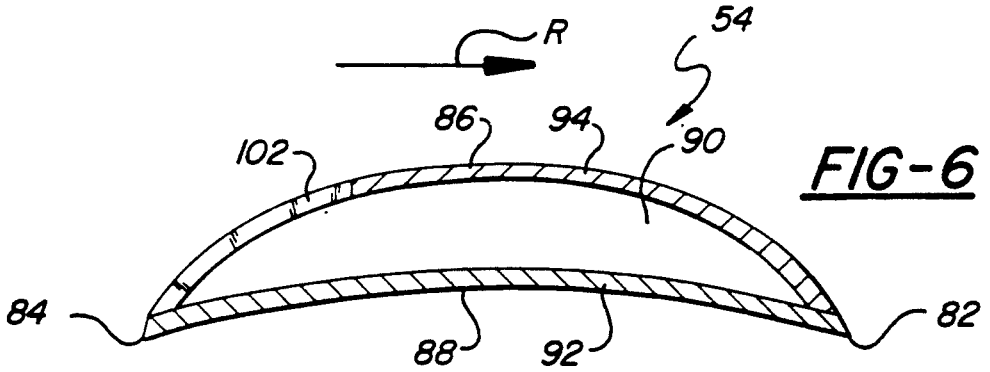
Figure 7:
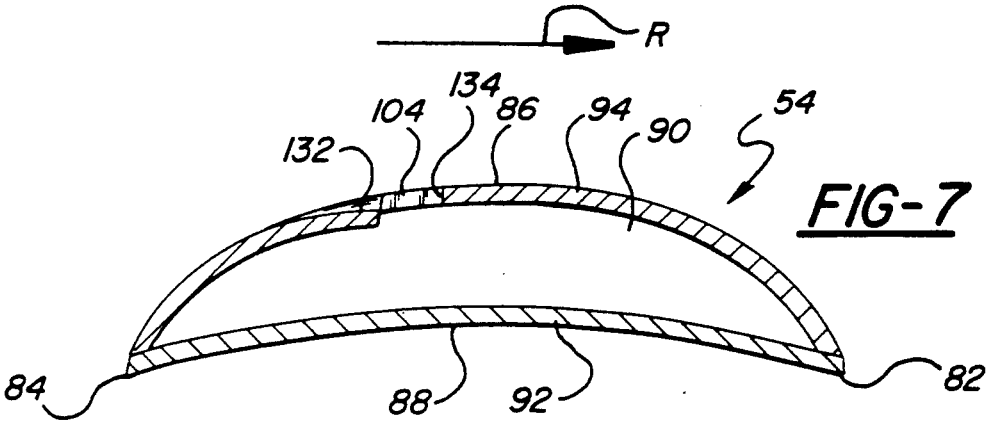
Figure 8:
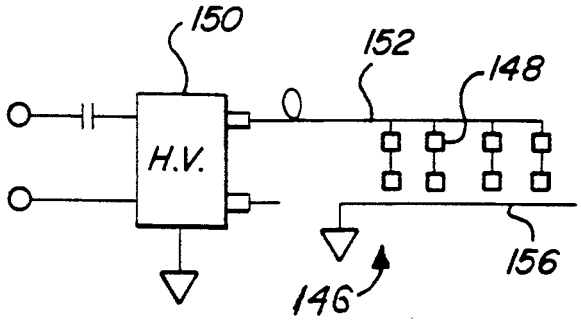

FIGS. 6 and 7 are sectional views taken on the lines 6—6 and 7—7, respectively, of FIG. 3;

FIG. 8 is a schematic electrical diagram of an ionizing system; and

Figure 9:
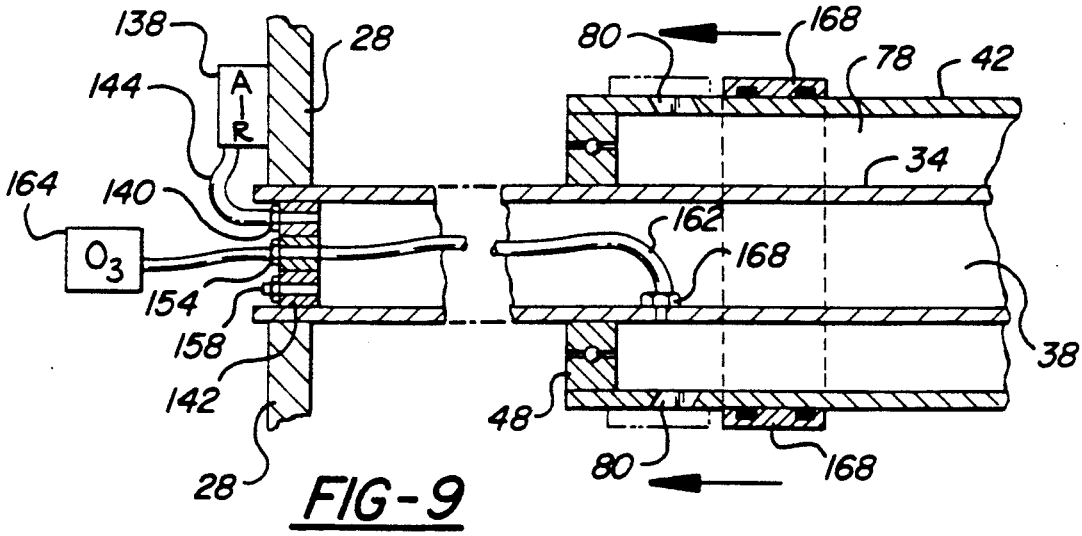

FIG. 9 is a fragmentary, cross-sectional view of a modified embodiment.

DETAILED DESCRIPTION OF THE PREFERRED EMBODIMENTS

Apparatus constructed according to the embodiment shown in FIGS. 1-8 is indicated generally at 10 and is especially adapted for treating ponds or pools of liquids by aeration and agitation. The apparatus 10 comprises an aerator 12 pivotally mounted on a support 14. The aerator 12 includes a base 16 having top and bottom walls 18, 20, a pair of side walls 22, 24, a front wall 26, and a recessed back wall 28.

An electric or other suitable drive motor 30 is bolted or otherwise mounted on the top wall 18 of the base 16. The motor 30 includes a rotary output shaft 32 extending forwardly along an axis of rotation A.

One end of a hollow, cylindrical, cantilever support arm 34 is mounted on the base 16 below the motor 30 and extends forwardly along an axis B to an open, free end 36. Within the support arm is a cavity 38 which extends between the free end 36 and the opposite end 40 that passes through both the front and back walls 26, 28 of the base 16 and is fixed to the base by welding or other suitable means.

A tubular, cylindrical drive shaft 42 is arranged coaxially about the support arm 34 and has a rear or out-of-water end 44 adjacent the base 16 and a forward or in-water end 46 adjacent the free end 36 of the support arm 34. A ball or roller bearing assembly 48 is mounted on the support arm 34 adjacent the rear end 44 of the drive shaft 42 and journals the drive shaft for rotation about the axis B.

A mixing propeller 50 is mounted on the free end 46 of the drive shaft 42 and includes a generally cylindrical, hollow hub 52 from which extends a plurality of circumferentially spaced mixing blades 54, each of which extends radially of the hub and terminates in a tip 56. Accommodated in the hub 52 is a cylindrical sleeve 58 spaced from the inner peripheral wall of the hub 52 and connected to the hub by a plurality of spokes 60 circumferentially spaced to allow air to pass between adjacent spokes.

An extension shaft 62 has a reduced diameter end portion extending through the sleeve 58 and into the nose cone 63 of the propeller 50. The reduced diameter end of the extension shaft 62 is threaded and receives a nut 64 for fastening the extension shaft 62 to the sleeve 58 to prevent relative rotation therebetween. The opposite end of the extension shaft 62 projects into the cavity 38 of the support arm 34 through the free end 36 thereof and along the axis B and is journaled on the support arm 34 by a bearing assembly 66 accommodated in the support arm adjacent its free end. The bearing assembly 66 preferably comprises a thrust bearing.

Secured to the extension shaft 62 on opposite sides of the bearing assembly 66 is a pair of retaining elements 68, 70 which react between the extension shaft and the bearing assembly to limit axial movement of the extension shaft, and thus axial movement of the propeller 50 and the drive shaft 42 with respect to the support arm 34. The retaining element 68 preferably comprises a snap ring, whereas the element 70 comprises a pin extending diametrally through the extension shaft 62.

A drive sprocket or pulley 72 is fixed to the motor shaft 32 for rotation therewith. A driven sprocket or pulley 74 is secured to the drive shaft 42 adjacent the end rear 44 and coupled to the drive pulley 72 by a flexible belt or chain 76.

The drive shaft 42 has a larger diameter than the support arm 34 so as to define an air passage or channel 78 communicating with the hollow hub 52. Extending through the wall of the drive shaft adjacent the out-of-water end 44 is a plurality of circumferentially spaced air inlets 80 through which air may pass into the channel 78.

Each of the blades 54 of the propeller 50 has a leading edge 82 and a trailing edge 84 relative to the direction of rotation of the propeller, such direction being indicated by the arrow R in FIG. 3. Each blade 54 has a root joined to the hub 52 and an airfoil cross-sectional profile between the edges 82, 84 defining a rear side 86 and a forward side 88 whereupon rotation of the propeller produces a variable low or negative pressure at the rear side 86 of each blade 54 which is greatest at a zone radially inward of the blade tip 56 and adjacent the trailing edge 84. Typically, the zone of greatest negative pressure of a blade is at a point closer to its tip than to its axis of rotation and is about 85% of the distance from the axis of rotation of the blade to its tip 56.

The airfoil profile of each blade 54 is such that, as is shown in FIGS. 6 and 7, the curvilinear distance across the rear side of the blade is greater than the distance across the forward side 88. Thus, as the propeller rotates, water is caused to flow across the rear side 86 of each blade at a speed greater than that across the forward side 88, thereby producing the aforementioned negative pressure at the rear side of the blade.

Figure 2:
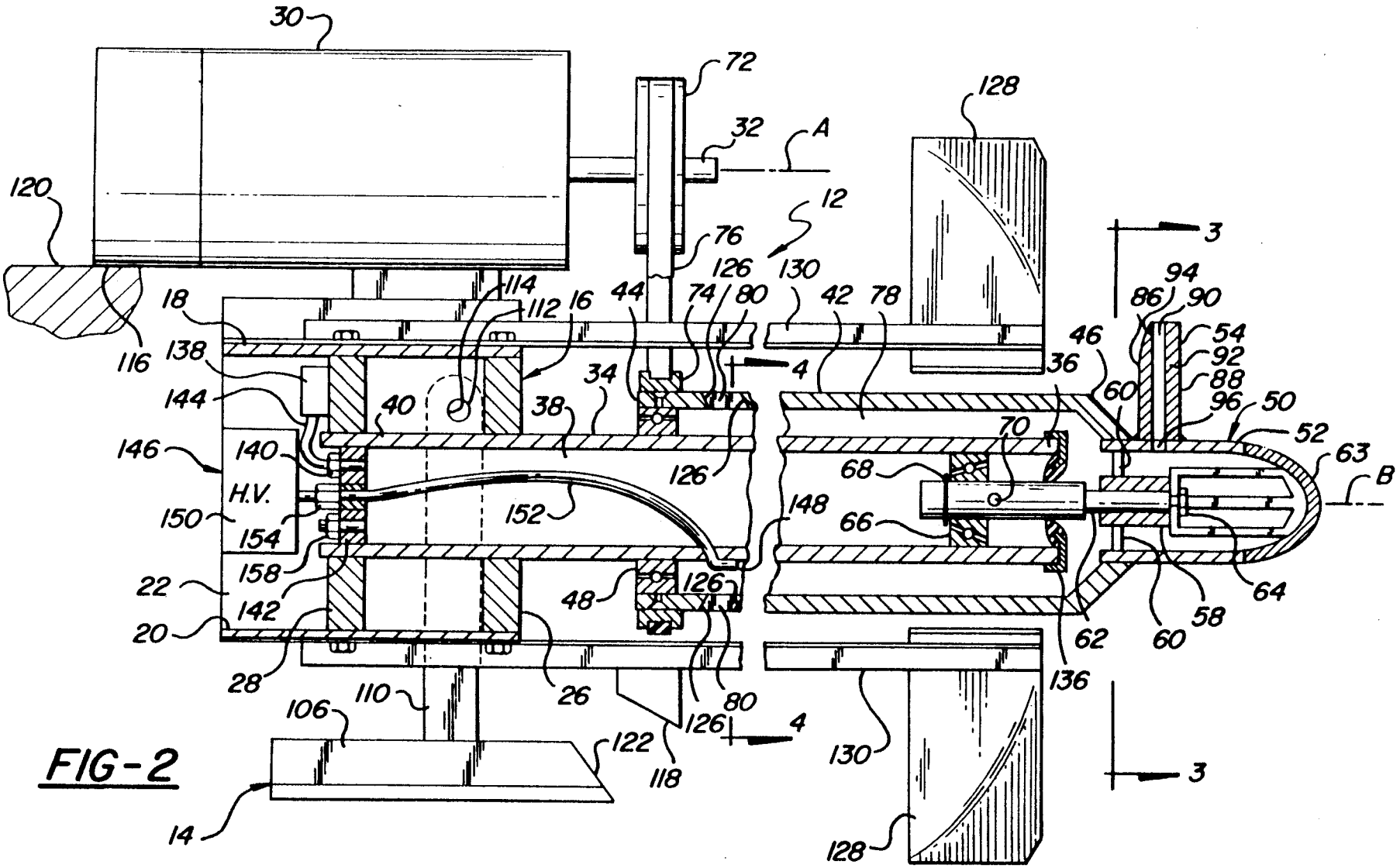
FIG. 2 is a fragmentary, partly elevational and partly cross-sectional view on an enlarged scale.

Each of the blades 54 is hollow and defines an internal air chamber 90 in fluid communication with the drive shaft air channel 78 through the hollow hub 52 (see FIG. 2). Each blade 54 includes a pair of front and rear walls 92, 94 which are spaced from one another to form the chamber 90. The front and rear walls of each blade 54 are secured to the hub 52 so that each chamber 90 is aligned with an associated passage 96 extending through the wall of the hub 52, thereby establishing fluid communication between the blade chambers 90 and the drive shaft air channel 78. The front and rear walls 92, 94 are joined along or adjacent the leading and trailing edges of each blade 54 in fluid tight manner. The front and rear walls 92, 94 may be formed as separate components which are welded or otherwise securely fixed to one another or, alternatively, such walls may be cast as integral portions of the propeller 50.

The front and rear walls 92, 94 of each blade converge in a direction toward the tip 56 and the rear wall 94 terminates in a barrier 98 in the vicinity of the zone of highest negative pressure, thereby closing off the chamber 90 radially inward of the blade tip 56. See FIG. 5.

The outer surface of the front wall 92 forms a portion of the forward side 86 of each blade 54, whereas the outer surface of the rear wall 94 defines the rear side 88 of each blade 54. The thickness of each blade where the front and rear walls 94, 96 are spaced from one another is substantially greater than that in the region radially outward of the barrier 98 near the tip 56. The added blade thickness in the chambered portion enhances or increases the negative pressure produced along the trailing edge 84 in response to rotation of the propeller 50. Although some increased drag is produced by thickening the cross section of the blades 54, the negative effect thereof is far outweighed by the increase in pressure drop along the trailing edge 84. The thickened profile, however, is discontinued at the barrier 98, since beyond this point lies a region 100 of high drag and relatively low negative pressure. To decrease drag and thus increase the efficiency of the propeller 50, the profile of the high drag region 100 of each blade is about $\frac{1}{3}$ to $\frac{1}{4}$ thinner than the thickened chamber region thereof.

Each of the blades 54 has a primary outlet port 102 extending through the rear wall 94 at or near the zone of highest negative pressure. As is shown best in FIGS. 3 and 5, the primary outlet port 102 commences closely adjacent the barrier 98 at the trailing edge 84 and extends transversely across the blade toward the leading edge 82, terminating at a back wall located at a point approximately $\frac{1}{3}$ the width of the blade.

Figure 5:
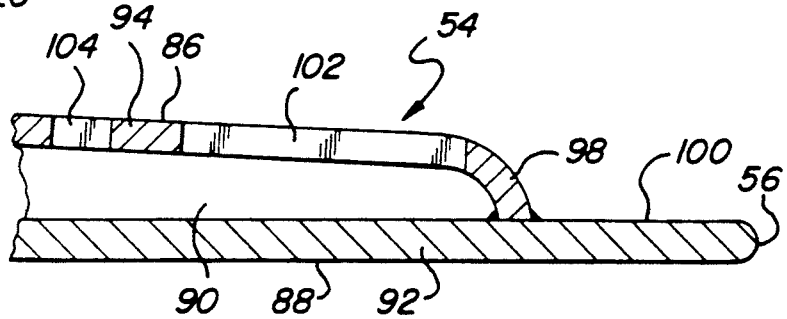
FIG. 5 is an enlarged sectional view taken on the line 5—5 of FIG. 3.

Each blade 54 also may include one or more secondary outlet ports 104 extending through the rear wall 94 at zones of lower pressure. The secondary port 104 shown in FIGS. 3, 5, and 7 is located radially inward of the primary port 102 and also at a position spaced from the trailing edge 84. Since the secondary port 104 is located where there is less differential pressure, the secondary outlet port is substantially smaller in area than that of the primary outlet port 102. The exact area of the secondary outlet 104 will depend on its location and the optimum size can be determined empirically.

The support 14 for the aerator includes a frame 106 mounted on a platform 108 and having a pair of uprights 110 extending upward on opposite sides of the base 16 of the aerator. Pivot pins 112 project from each side 22, 24 of the base 16 and are journaled in a pair of apertures 114 in the uprights 110. The platform 108 may comprise either a stationary support structure or, alternatively, a flotation device. The support means 14 supports the motor 30, the base 16, and the air inlet ports 80 of the drive shaft 42 at all times at a level above the surface of the water W, as shown in FIG. 1.

Figure 1:
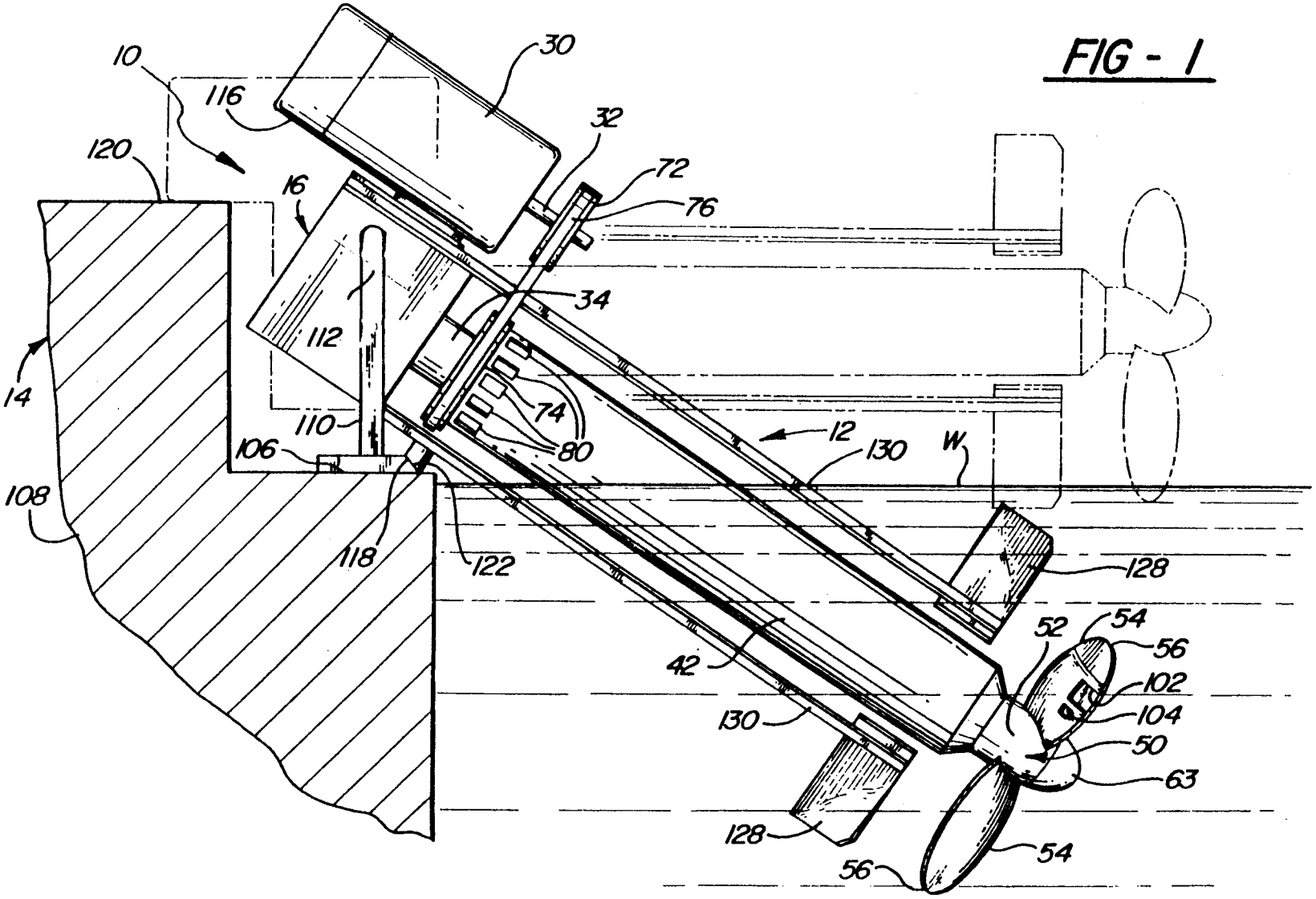
FIG. 1 is a diagrammatic, fragmentary, side elevation view of the apparatus.

The aerator 12 includes an abutment 116 on the motor 30 and an abutment 118 on the frame 106 which limit the range of pivotal movement of the aerator 12 between the downwardly tilted operational position, shown in full lines in FIG. 1, and an inactive, generally horizontal dry-docked position indicated by broken lines in FIG. 1. Cooperable with the abutment 116 to limit counterclockwise movement of the aerator 12 is an abutment surface 120 engageable by the abutment 116. When the aerator 12 is in the generally horizontal dry-docked position, the entire drive shaft 42 is supported at a level above the surface of the water W. The radial length of each blade 54, however, is somewhat greater than the distance from the water surface to the axis B so that rotation of the propeller will cause the blade tips to engage the water.

In the inactive position of the apparatus, the shaft 42 and the primary and secondary air outlets 102, 104 also are supported above the level of the water W. Locating the drive shaft of the aerator in this position allows any water present in the air channel 78 to exit through the outlets 102, 104 in the blades. This is significant when treating a liquid such as waste water since allowing the water to remain in the air channel 78 for any appreciable period of time enables algae and other bacterial matter to accumulate in the channel 78 and interfere with the passage of air therethrough. Such waste water also is very corrosive and damaging to any seals and bearings with which it comes in contact.

The apparatus 10 includes automatically operable means for moving the aerator drive shaft and propeller from the inactive position to the operational position upon energization of the motor 30 and from the operational position to the inactive position upon de-energization of the motor. In the preferred embodiment, the aerator is biased by gravity toward the dry-docked or inactive position. This is accomplished by offsetting the pivot pins 112 forwardly of the center of gravity C.G. of the aerator 12, as shown in FIG. 1. By offsetting the pivot axis, the unequally distributed weight of the aerator 12 continuously urges the aerator 12 to rock counterclockwise, as viewed in FIG. 1, until the stop 116 engages the abutment surface 120 of the platform 108.

Energizing the motor 30 causes the drive shaft 42 and propeller 50 to rotate in the direction of the arrow R. The blades 54 are of such pitch that, upon rotation, the blade tips 56 engage and react with the water W to produce a force which tends to rock the aerator 12 clockwise toward the operational position. When the speed of rotation of the propeller is sufficient to cause the torsional force to overcome the opposing biasing force, the aerator 12 will move to the operational position shown in solid lines in FIG. 1. The support frame 106 includes an abutment surface 122 which engages the stop 118 of the aerator 12 to limit the clockwise movement of the aerator and position the aerator at an angle of approximately 30° to the horizontal.

As the blades 54 of the propeller 50 rotate in the water W, a large amount of thrust is created which causes masses of water to be propelled axially forwardly of the aerator 12 with great force. This action causes mixing or agitation of the water W. As the water W passes across the fore and aft surfaces 86, 88 of the blades 54, negative differential pressure is created along the trailing edge 84 of the blades and is greatest in the vicinity of the primary air outlet 102. This negative differential pressure draws atmospheric air into the channel 78 through the air inlets 80, thence into the hollow hub 52 and air chambers 90 of the blades 54, and then out the primary and secondary outlets 102, 104 into the water as a fine dispersion of bubbles which are mixed with the masses of water propelled by the propeller 50 forming a plume of entrained air bubbles of as much as 30 feet long.

Since the air inlets 80 extend through the side wall of the drive shaft 42, the inlets 80 rotate with the drive shaft 42 during operation of the aerator 12. The rotating inlets 80 have the effect of separating water, dust, and other impurities from the entrained air prior to its entry into the channel 78. More specifically, as the drive shaft 42 spins, it causes the air closely adjacent the drive shaft also to spin. This produces centrifugal force which separates the denser water particles and other impurities from the air preventing their entry into the channel 78.

Figure 4:
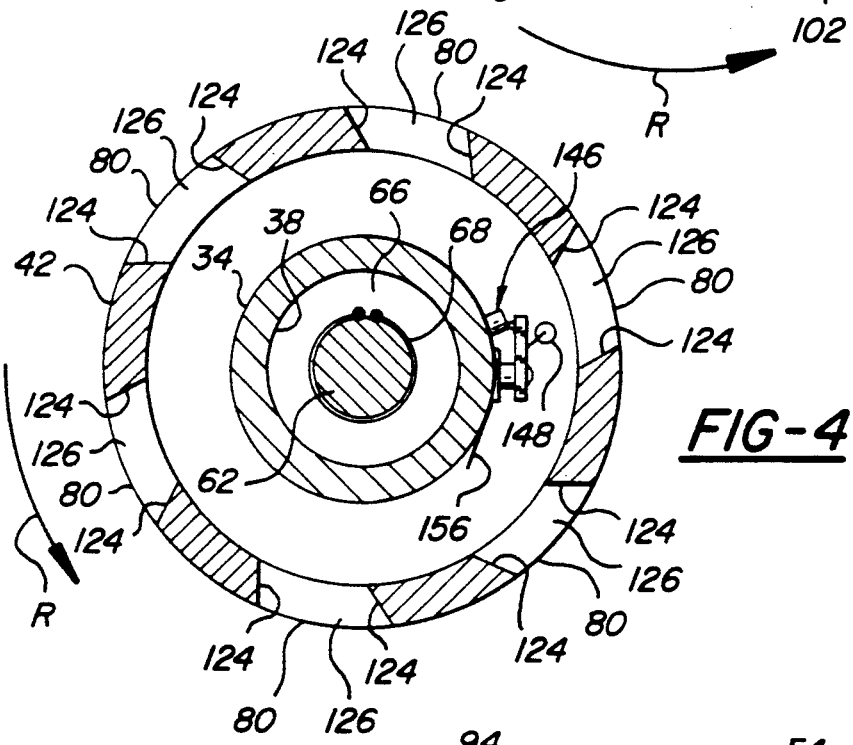
FIG. 4 is a sectional view taken on the line 4—4 of FIG. 2.

Each of the inlets 80 is shaped to promote the entry of air into the channel 78. As shown in FIG. 4, each of the air inlets 80 includes a pair of side walls 124 that are inclined or slanted radially in the direction of rotation R of the drive shaft 42. The inclined side walls 124 act as knife edges that direct the air into the channel 78 upon rotation of the drive shaft 42. As shown in FIG. 2, each of the air inlets 80 also includes opposed front and back walls 126 which are slanted axially away from the propeller 50. The momentum of the air entering the channel 78 creates a flow of incoming air axially along the drive shaft in the direction of the propeller 50. The front and back walls 126 are slanted toward the incoming flow of air to create a more direct axial flow path into the channel 78. When fully operational, the air moves through the channel at speeds up to 60 miles per hour.

Like the air, the water that is adjacent the rotating drive shaft 42 also has a tendency to spin with the drive shaft and flow axially along the drive shaft 42 toward the propeller. To discontinue spinning of water flowing to the propeller, and thus enable the aerator 12 to operate more efficiently, the aerator 12 is provided with a flow alignment stator comprising a pair of fins 128 extending from the base frame 16 and supported by struts 130. The fins 128 project radially outwardly of the drive shaft 42 and are twisted along their length to straighten the flow of water to the propeller 50. As shown in FIG. 2, there are preferably two alignment fins 128 arranged above and below the drive shaft 42. A leg depends from the lower support member 130 and serves as the stop 118 of the aerator 12.

During operation of the aerator 12, the flow of air through the outlets 102, 104 prevents the backing of any water into the air channel 78 via the outlets. Since the secondary outlet 104 is in a region of lower differential pressure than the primary outlet 102, the area of the secondary outlet is sufficiently small to prevent the hydrostatic water pressure from overcoming the negative pressure across the outlet 104 and enable water to enter the chamber 90 during operation. The size of the outlet 104 may be determined empirically. The secondary outlet 104 includes a back wall 132 and a front wall 134, respectively. See FIG. 7. The back wall 132 is depressed into the chamber 90 to provide a more direct transverse flow path for the air discharged through the secondary outlet 104.

Upon de-energization of the motor 30, the speed of the drive shaft 42 and propeller 50 slows and eventually comes to a stop. Along with the decrease in speed comes a corresponding decrease in the differential pressure at the outlets 102 and 104 and hence a decrease in the air flow through the outlets. Further, as the speed of the propeller 50 decreases, there is a corresponding decrease in the torsional force exerted on the water by the propeller 50. As the torsional force decreases, the gravity biasing force overcomes the torsional force and pivots the aerator 12 toward the horizontal inactive position.

Even though the movement of the aerator to its inactive position is fairly rapid, there may be a short period of time in which the pressure at the outlets 102, 104 falls below the hydrostatic pressure of the water, thereby allowing water to enter the channel 78 through the outlets 102, 104 To protect the bearing 66 (which is below the surface of the water during operation of the aerator 12) against contact with corrosive water should it enter the channel 78, a lip seal 136 is mounted on the free end 36 of the support arm 34 in engagement with the extension shaft 62 to prevent water from entering the hollow support arm 34.

Over time the lip seal 136 will become worn and lose its sealing effectiveness. To provide protection for the bearing 66 under these conditions, the aerator 12 includes pressurizing means for maintaining positive pressure on the lip seal 136 at all times to prevent the waste water from flowing past the lip seal even when the latter is worn. The pressurizing means comprises a small electric air compressor 138, such as is commonly used with an aquarium tank, connected via a line 144 to a fitting 140 extending through a bulkhead 142. The compressor 138 forces air under approximately 2 to 3 psi into the support arm 34 to provide positive pressure between the bearing assembly 68 and the lip seal 136. Thus, even when the lip seal 136 becomes worn, the air pressure from the compressor 138 provides a positive flow of air through the seal to prevent the backflow of water past the seal.

To increase aeration efficiency, it may be desirable to convert the oxygen in the air stream flowing through the channel 78 to ozone. For this purpose, the aerator 12 is provided with ionizing means indicated generally at 146 in FIG. 8 which ionizes the oxygen in the air drawn into the air channel 78 and converts the oxygen to ozone before discharge into the water through the outlets 102, 104. The ionizing means 146 includes positive electrodes 148 mounted on the outer periphery of the support arm 34 in the vicinity of the air inlets 80 and connected to a high voltage source 150 by wiring 152.

The high voltage source 150 preferably is mounted on one of the side walls of the base frame 16 behind the support arm 34. The wiring 152 is accommodated within the support arm 34 and one end thereof extends through a fitting 154 in the bulkhead 142 and is connected to the high voltage source 150. The opposite end of the wiring extends through an opening in the support arm wall 34 and is connected to the positive electrodes 148. A negative electrode 156 also is mounted on the support arm 34 within the channel 78 in closely spaced relationship to the positive electrodes 148.

Energizing the high voltage source 150 produces arcing across the positive and negative electrodes 148, 156 which in turn ionizes the oxygen in the air entering the air inlets 80 and converts it to ozone before discharge through the outlets 102 and 104.

The bulkhead 142 is provided with another through fitting 158 which serves as an access into the support arm 34 for lubricating the bearing 66.

FIG. 9 shows an alternative embodiment of the invention wherein the ionizing apparatus 146 is replaced with an ozone injection assembly for introducing ozone directly into the channel 78 for discharge into the water through the outlets 102 and 104. The injection assembly includes a conduit 162 accommodated within the support arm 34 and having one end thereof passing through the fitting 154 of the bulkhead 142 and connected to a source 164 of ozone. The opposite end of the conduit 162 is connected to the channel 78 by a fitting 166 extending through the wall of the support arm 134. The conduit 162 serves to direct the ozone into the channel 78 for subsequent discharge into the water.

Means is provided for selectively opening and closing the air inlets 80 during the injection of ozone and comprises a sleeve 168 supported on the drive shaft 42 and movable axially thereof between a fully open position, as shown in solid lines in FIG. 9, to a completely closed position, as shown in broken lines in FIG. 8, wherein the air inlets 80 are completely closed off by the sleeve 168 to prevent air from entering the channel 78. The sleeve may be moved to any selected one of a number of positions between the fully opened and fully closed positions to regulate the amount of air that may enter the channel 78 through the inlets 80.

The disclosed embodiments are representative of preferred forms of the invention, but are intended to be illustrative rather than definitive thereof. The invention is defined in the claims.

I claim:

1. Apparatus for aerating liquids comprising a drive shaft having an aerating fluid passage therein; means journaling said shaft for rotation about an axis; motor means coupled to said drive shaft for rotating said shaft about said axis; a propeller connected to said drive shaft for rotation therewith, said propeller having a plurality of blades each of which has an outlet port in communication with said passage and through which said fluid may be discharged in response to rotation of said propeller in said liquid; means mounting said shaft for movements between an operational position in which said blades and said outlet ports are immersed in the liquid and an inactive position in which said passage is above the level of the liquid; and means responsive to rotation of said propeller for automatically moving said shaft to said operational position and responsive to termination of rotation of said propeller to move said shaft to said inactive position.

2. Apparatus as set forth in claim 1 including means for limiting the movement of said shaft between said positions.

3. Apparatus as set forth in claim 1 including seal means in said shaft between said propeller and said journaling means for sealing said journaling means from the liquid, and means for maintaining in said shaft between said seal means and said journaling means a pressure sufficiently high to prevent liquid from passing through the seal means in a direction toward said journaling means.

4. Apparatus as set forth in claim 1 wherein said shaft is continuously biased toward said inactive position.

5. Apparatus as set forth in claim 4 wherein said shaft is gravity biased toward said inactive position.

6. Apparatus as set forth in claim 1 wherein each of said blades has a free tip and an airfoil profile defining a suction side of said blade and a thrust side of said blade whereby rotation of said blade in said liquid produces a negative pressure on said suction side which is greatest at a zone radially inward of said tip, each of said blades having said outlet port at said zone.

7. Apparatus as set forth in claim 6 wherein each of said blades has at least one other outlet port in said suction side of said blade and in communication with said passage, said other outlet port being located radially inward of said zone.

8. Apparatus as set forth in claim 7 wherein said other port has an area less than that of the outlet port at said zone.

9. Apparatus as set forth in claim 1 wherein said passage communicates with a source of aeration fluid via at least one slot in said shaft.

10. Apparatus as set forth in claim 9 including means for regulating the quantity of fluid admitted to said passage.

11. Apparatus as set forth in claim 9 wherein said slot has a pair of side walls that are slanted in the direction of rotation of said shaft.

12. Apparatus according to claim 11 wherein said aeration fluid comprises ozone.

* * * * *